US007671525B2

(12) United States Patent
Kim

(10) Patent No.: US 7,671,525 B2
(45) Date of Patent: Mar. 2, 2010

(54) ELECTRON EMISSION DEVICE AND ELECTRON EMISSION DISPLAY HAVING THE SAME

(75) Inventor: Si-Myeong Kim, Yongin-si (KR)

(73) Assignee: Samsung SDI Co., Ltd, Suwon-Si (KR)

( * ) Notice: Subject to any disclaimer, the term of this patent is extended or adjusted under 35 U.S.C. 154(b) by 0 days.

(21) Appl. No.: 11/584,128

(22) Filed: Oct. 20, 2006

(65) Prior Publication Data

US 2007/0096625 A1 May 3, 2007

(30) Foreign Application Priority Data

Oct. 31, 2005 (KR) ..... 10-2005-0103533

(51) Int. Cl.
*H01J 63/04* (2006.01)
*H01J 1/62* (2006.01)

(52) U.S. Cl. ..... 313/495; 313/496; 313/497

(58) Field of Classification Search ..... 313/495–500, 313/306, 309, 310–311, 351, 346 R, 336; 445/24, 49–51

See application file for complete search history.

(56) References Cited

U.S. PATENT DOCUMENTS

| | | | | |
|---|---|---|---|---|
| 5,786,659 | A * | 7/1998 | Takagi et al. | 313/309 |
| 5,838,095 | A * | 11/1998 | Tanaka et al. | 313/309 |
| 6,060,841 | A * | 5/2000 | Niiyama et al. | 315/169.3 |
| 6,259,198 | B1 * | 7/2001 | Yanagisawa et al. | 313/495 |
| 6,420,827 | B1 * | 7/2002 | Lee et al. | 313/496 |
| 2004/0164665 | A1 * | 8/2004 | Sasaki et al. | 313/495 |
| 2005/0040752 | A1 * | 2/2005 | Lee et al. | 313/495 |
| 2005/0082964 | A1 * | 4/2005 | Konishi | 313/497 |
| 2005/0133779 | A1 * | 6/2005 | Choi et al. | 257/10 |
| 2005/0168128 | A1 * | 8/2005 | Kang | 313/495 |
| 2005/0189870 | A1 * | 9/2005 | Lee et al. | 313/497 |
| 2005/0242707 | A1 * | 11/2005 | Hwang | 313/497 |
| 2006/0091780 | A1 * | 5/2006 | Minami | 313/495 |
| 2006/0208628 | A1 * | 9/2006 | Lee | 313/497 |

FOREIGN PATENT DOCUMENTS

| | | |
|---|---|---|
| JP | 11-162326 | 6/1999 |
| JP | 11162326 A * | 6/1999 |

OTHER PUBLICATIONS

European Search Report dated Oct. 30, 2007, for EP 06122892.0, which corresponds to Korean priority KR 10-2005-0103533, in the name of Samsung SDI Co., Ltd.

Patent Abstracts of Japan, Publication No. 11-162326, dated Jun. 18, 1999, in the name of Yukihiro Kondo et al.

* cited by examiner

*Primary Examiner*—Joseph L Williams
*Assistant Examiner*—Elmito Breval
(74) *Attorney, Agent, or Firm*—Christie, Parker & Hale, LLP.

(57) ABSTRACT

An electron emission device and display including the same include a substrate; a cathode electrode including a first electrode portion formed on the substrate and having opening portions, and second electrode portions placed within respective ones of the opening portions such that the second electrodes are separated from the first electrode; a resistance layer electrically interconnecting the first electrode portion and the second electrode portions of the cathode electrode; and electron emission regions electrically connected to the second electrode portions. A width of the second electrode portions or of the resistance layer between the first and second electrode portions varies along a longitudinal direction of the cathode electrode.

20 Claims, 4 Drawing Sheets

ELECTRON EMISSION DEVICE AND ELECTRON EMISSION DISPLAY HAVING THE SAME

CROSS REFERENCE TO RELATED APPLICATION

The present application claims priority to and the benefit of Korean Patent Application No. 10-2005-0103533 filed on Oct. 31, 2005, in the Korean Intellectual Property Office.

BACKGROUND OF THE INVENTION

1. Field of the Invention

The present invention relates to an electron emission device, and in particular, to an electron emission display which has an electron emission device with electrodes for emitting electrons from electron emission regions.

2. Description of Related Art

In conventional field emitter array electron emission devices, cathode electrodes are electrically connected to the electron emission regions to supply required electric currents. When driving voltages are applied to the cathode electrodes to form electric fields, electrons are emitted from the electron emission regions due to the electric fields. If an unstable voltage is applied to the cathode electrode or a voltage drop is made with respect to the cathode electrode, different voltages may be applied to the electron emission regions of the respective pixels. In this case, the amount of current discharged from the respective electron emission regions is not uniform, and hence, the uniformity in light emission per the respective pixels is deteriorated.

In one approach to solve such a problem, a resistance layer is applied to the cathode electrode to control the amount of the electric current applied to the respective electron emission elements. The electron emission element is, for instance, formed with two electrodes separated from each other on the same plane as the cathode electrode. The two electrodes are connected to each other by way of a resistance layer, and the electron emission region is formed at one of the two electrodes. In this case, the resistance made entirely in-between the respective electrodes is the same.

However, when the same resistance is entirely made in-between the electrodes, even with the application of the resistance layer, the voltage drops in the longitudinal direction of the cathode electrode due to the internal resistance of the cathode electrode. Accordingly, this approach is limited in obtaining excellent electron emission uniformity with the electron emission device having the resistance layer.

SUMMARY

An electron emission device includes a substrate; a cathode electrode including a first electrode portion formed on the substrate and having opening portions, and second electrode portions placed within respective ones of the opening portions such that the second electrodes are separated from the first electrode; a resistance layer electrically interconnecting the first electrode portion and the second electrode portions of the cathode electrode; and electron emission regions electrically connected to the second electrode portions. A width of the second electrode portions varies along a longitudinal direction of the cathode electrode.

The width of the second electrode portions may be gradually enlarged or reduced from a first end to a second end of the cathode electrode, the second end being opposite to the first end.

Each of the opening portions may have a predetermined width in the longitudinal direction of the cathode electrode, and the resistance layer may be disposed between the first electrode portion and the second electrode portions in the longitudinal direction of the cathode electrode. A second resistance layer may also be included, and the resistance layer and the second resistance layer may be arranged at opposite sides of the second electrode portions.

The resistance layer may be disposed between the first electrode portion and the second electrode portions, and contact a lateral side and a peripheral top surface of the first electrode portion and the second electrode portions.

The first electrode portion may be formed with a transparent conductive material, and the second electrode portions may be formed with a transparent conductive material or a metallic material. The resistance layer may be formed with amorphous silicon.

In one embodiment, the electron emission regions are formed with a material selected from the group consisting of carbon nanotube, graphite, graphite nanofiber, diamond, diamond-like carbon, fullerene C60, and silicon nanowire.

Gate electrodes and a focusing electrode may be formed on the cathode electrode, wherein the gate electrodes are insulated from the focusing electrode.

In one embodiment, an electron emission device includes a substrate; a cathode electrode including a first electrode portion formed on the substrate and having opening portions, and second electrode portions placed within respective ones of the opening portions such that the second electrodes are separated from the first electrode; a resistance layer electrically interconnecting the first electrode portion and the second electrode portions of the cathode electrode; and electron emission regions electrically connected to the second electrode portions. A width of the resistance layer disposed between the first electrode portion and the second electrode portions varies in a longitudinal direction of the cathode electrode.

In another embodiment, an electron emission display includes a substrate; a cathode electrode including a first electrode portion formed on the substrate and having opening portions, and second electrode portions placed within respective ones of the opening portions such that the second electrodes are separated from the first electrode; a resistance layer electrically interconnecting the first electrode portion and the second electrode portions of the cathode electrode; electron emission regions electrically connected to the second electrode portions; a counter substrate facing the substrate; and a light emission unit formed on a surface of the counter substrate. A width of the resistance layer disposed between the first electrode portion and the second electrode portions is varied in a longitudinal direction of the cathode electrode. In another embodiment, a width of the second electrode portions varies along a longitudinal direction of the cathode electrode.

The light emission unit may include phosphor layers formed on the counter substrate and an anode electrode formed on the counter substrate such that the anode electrode is connected to the phosphor layers.

BRIEF DESCRIPTION OF THE DRAWINGS

The above and other aspects of the present invention will become more apparent by describing examples of embodiments thereof in detail with reference to the accompanying drawings in which.

DETAILED DESCRIPTION

The present invention will be described more fully hereinafter with reference to the accompanying drawings, in which examples of embodiments of the invention are shown.

Figure 1:
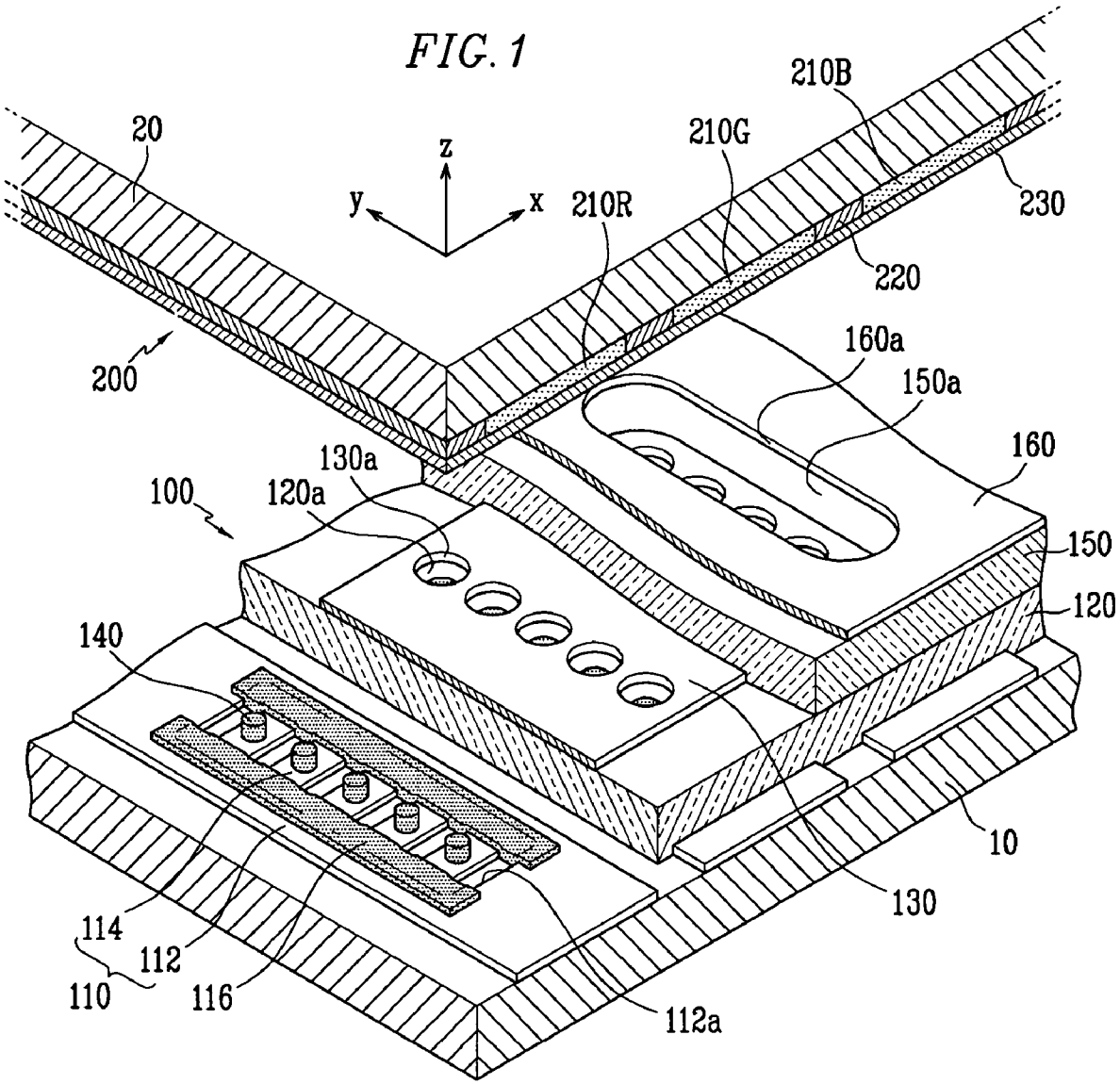
FIG. 1 is a partial exploded perspective view of an electron emission display according to an embodiment of the present invention.
Figure 2:
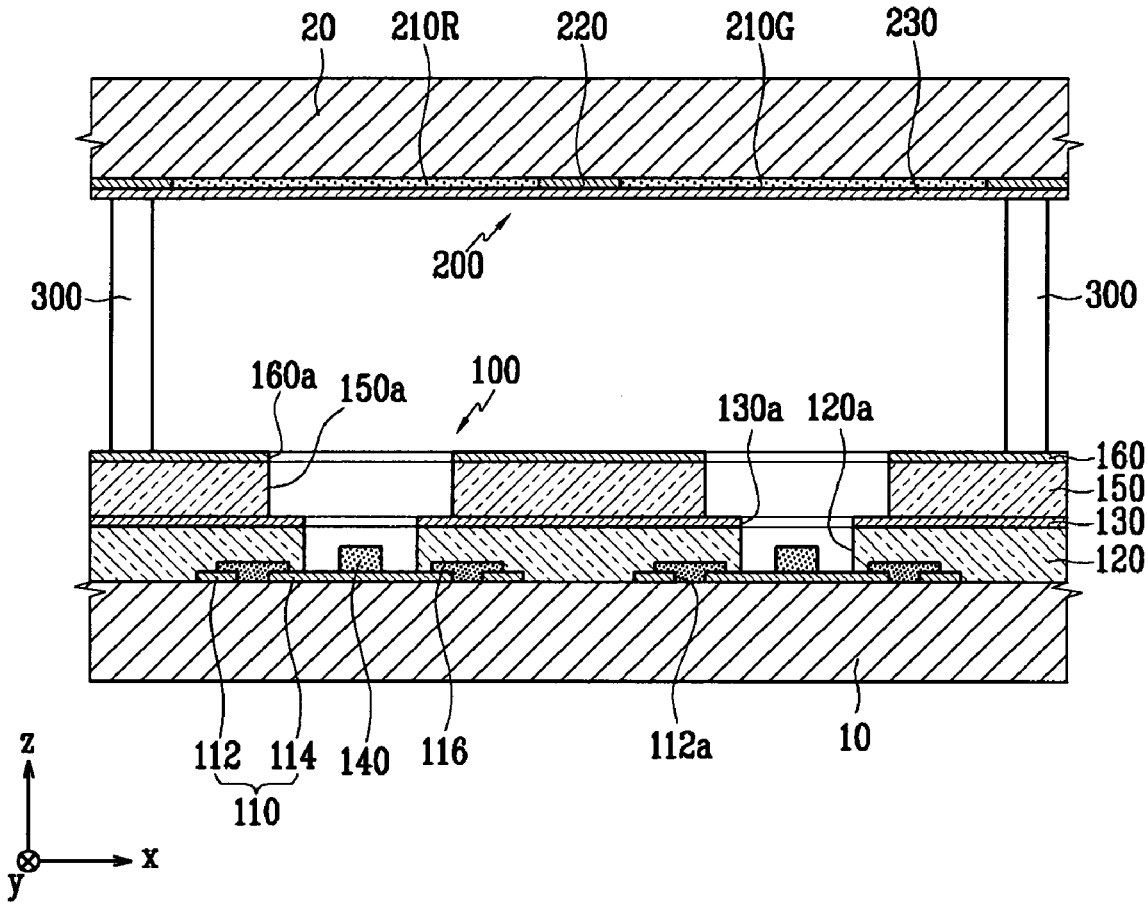
FIG. 2 is a partial sectional view of the electron emission display according to the embodiment shown in FIG. 1.

As shown in FIGS. 1 and 2, an electron emission display includes first and second substrates 10 and 20 separated and facing each other in parallel. The first and the second substrates 10 and 20 are sealed to each other at the peripheries thereof by way of a sealing member (not shown) to form a vessel, and the internal space of the vacuum vessel is evacuated to be at $10^{-6}$ Torr, thereby constructing a vacuum vessel.

Arrays of electron emission elements are arranged on a surface of the first substrate 10 facing the second substrate 20 to form an electron emission device 100 together with the first substrate 10.

The electron emission device forms an electron emission display together with the second substrate 20 and a light emission unit provided on the second substrate 20.

The electron emission display will be now explained in detail.

Cathode electrodes 110 are stripe-patterned on the first substrate 10 along a direction (e.g., in the y axis direction of FIGS. 1 and 2).

A first insulating layer 120 is formed on the entire surface of the first substrate 10 such that it covers the cathode electrodes 110. Gate electrodes 130 are stripe-patterned on the first insulating layer 120 perpendicular to the cathode electrodes 110 (e.g., in the x axis direction of FIG. 1).

Accordingly, the cathode and the gate electrodes 110 and 130 cross each other, and each crossed region thereof forms a pixel.

In this embodiment, each cathode electrode 110 includes a first electrode 112, and second electrodes 114. An opening portion 112*a* is formed at the first electrode 112 per the respective pixels, and second electrodes 114 are placed within the opening portion 112*a* such that they are separated from the first electrode 112.

An electron emission region 140 is formed on the second electrode 114, and resistance layers 116 are disposed between the first and the second electrodes 112 and 114 to electrically interconnect the first and the second electrodes 112 and 114.

The first and the second electrodes 112 and 114 are formed on the same plane, and the resistance layers 116 are placed at both sides of the second electrodes 114 in the longitudinal y direction of the cathode electrode 110 such that they contact the first and the second electrodes 112 and 114.

The resistance layer 116 may be formed with a material having a specific resistivity of 10,000~100,000 Ωcm. The resistance layer 116 may bear a resistance greater than the conductive material-based cathode electrode 110. For instance, the resistance layer may be formed with p-type or n-type doped amorphous silicon Si.

As shown in FIGS. 2, 3, 4, and 5, the opening portions 112*a* of the first electrode 112 substantially correspond to the crossed regions of the gate and the cathode electrodes 130 and 110. The opening portion 112*a* has a width d in the longitudinal direction of the cathode electrode 110.

A second electrode 114 is placed within the opening portion 112*a* such that it is spaced apart from the first electrode 112. The second electrode 114 is gradually enlarged in width from a width w11 on one side 1lOS of the cathode electrode 110 to a width w12 on the other end 110E of the cathode electrode 110 receiving the voltage to the opposite-sided end 110E thereof.

Accordingly, the distance d21 and d22 between the first and the second electrodes 112 and 114 as well as the width w21 and w22 of the resistance layers 116 disposed between those electrodes are varied in the longitudinal direction of the cathode electrode 110.

Figure 4:
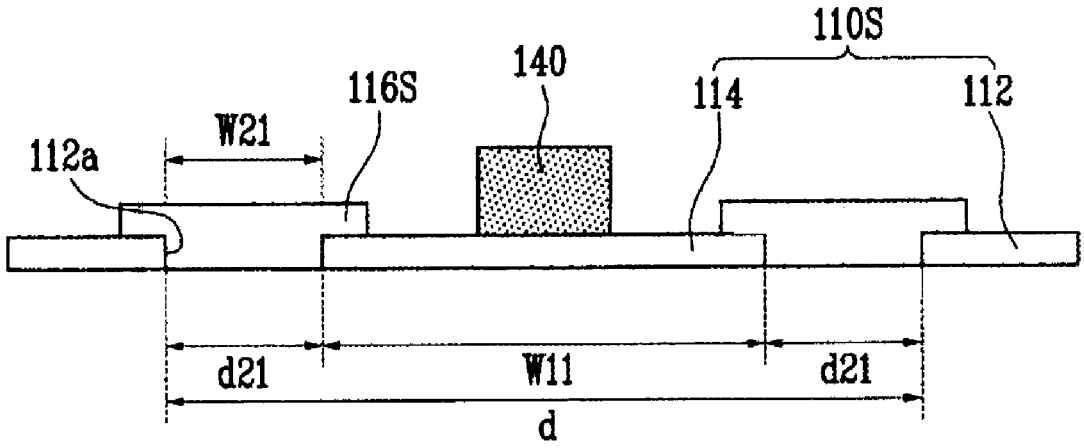
FIG. 4 is a cross sectional view of the electron emission display of FIG. 3 taken along the IV-IV line.
Figure 5:
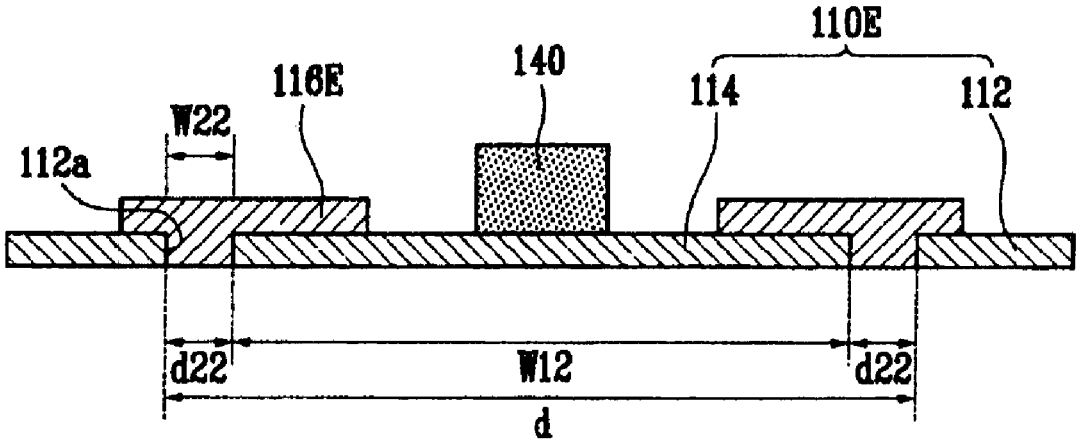
FIG. 5 is a cross sectional view of the electron emission display of FIG. 3 taken along the V-V line.

That is, as shown in FIGS. 4 and 5, the distance d21 between the first and the second electrodes 112S and 114 at the one-sided end 110S of the cathode electrode 110 is greater than the distance d22 between the first and the second electrodes 112E and 114 at the opposite-sided end 110E of the cathode electrode 110.

Accordingly, the width of the resistance layer 116S between the first and the second electrodes 112 and 114 at the one-sided end 110S of the cathode electrode 110 is greater than that of the resistance layer 116E at the opposite-sided end 110E thereof (w21>w22).

Accordingly, the resistance made in-between the first and the second electrodes 112 and 114 is gradually reduced in the longitudinal direction of the cathode electrode 110, that is, in the direction of the electric current flow along the cathode electrode 110. Then, a relatively high resistance is made at the one-sided end 110S of the cathode electrode 110, and a relatively low resistance at the opposite-sided end 110E thereof.

The first and the second electrodes 112 and 114 are all formed with a transparent conductive material such as ITO and IZO. Alternatively, the first electrode 112 may be formed with a transparent material such as ITO and IZO, and the second electrode 114 with a conductive material bearing an electrical conductivity higher than the first electrode 112, such as chromium Cr, molybdenum Mo, niobium Nb, nickel Ni, tungsten W, and tantalum Ta.

The electron emission regions 140 are formed with a material emitting electrons when an electric field is applied thereto under a vacuum atmosphere, such as a carbonaceous material and a nanometer-sized material. That is, the electron emission regions may be formed with carbon nanotube, graphite, graphite nanofiber, diamond, diamond-like carbon, $C_{60}$ (fullerene), silicon nanowire, or a combination thereof. Alternatively, the electron emission regions may be formed with a sharp-pointed tip structure mainly based on molybdenum or silicon.

In this embodiment, the resistance layer 116 extends over the first and the second electrodes 112 and 114, and contacts the lateral side and peripheral top surface of the first and the second electrodes 114. Such a large contact area may be advantageous in this embodiment. Alternatively, the resistance layer 116 may contact only the lateral side of the first and the second electrodes 112 and 114.

Figure 3:
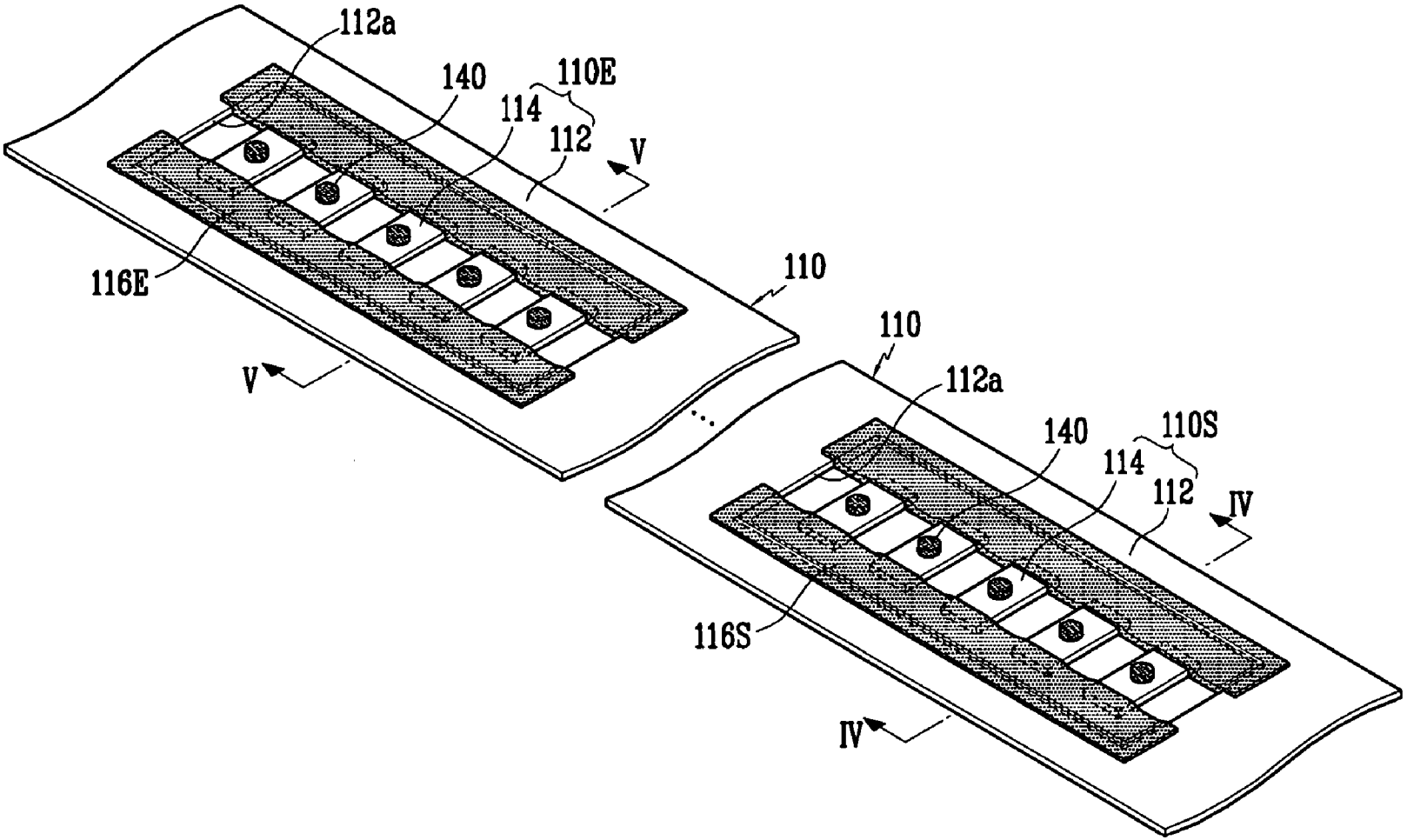
FIG. 3 is a perspective view of components of the electron emission display according to the embodiment shown in FIGS. 1 and 2.

As shown in FIGS. 1 and 3, five second electrodes 114 with a rectangular plane shape are placed within each opening portion 112*a* of the first electrode 112, and arranged in the form of islands along the length of the cathode electrode 110. One electron emission region 140 with a circular plane shape is placed on the second electrode 114, and resistance layers are single-patterned at both sides of the first electrode 112 in the longitudinal direction of the cathode electrode 110 such that they interconnect the first and the second electrodes 112 and 116. However, the invention is not limited to the plane shape of the second electrode 114 and the electron emission region 140, the number of the second electrodes 114, and the resistance layer patterns 116 per the respective opening portions 112*a* of the first electrode 112, but may be altered in various manners.

As previously shown in FIGS. 1 and 2, a first insulating layer 120 is formed on the cathode electrodes 110 such that it entirely covers the first substrate 10. Gate electrodes 130 are stripe-patterned on the first insulating layer 120 perpendicular to the cathode electrodes 110 (in the x axis direction of FIG. 1).

Opening portions 120*a* and 130*a* are formed at the first insulating layer 120 and the gate electrodes 130 corresponding to the respective electron emission regions 140 to expose the electron emission regions 140 on the first substrate 10. The electron emission regions 140 and the opening portions 120*a* and 130*a* are circular-shaped in FIGS. 1 and 2, but the plane shape thereof is not limited thereto. That is, the plane shape of the electron emission regions 140 and the opening portions 120*a* and 130*a* may be altered in various manners.

A second insulating layer 150 and a focusing electrode 160 are sequentially formed on the gate electrodes 130. A second insulating layer 150 is placed under the focusing electrode 160 to insulate the gate electrodes 130 and the focusing electrode 160 from each other. Opening portions 150*a* and 160*a* are formed at the second insulating layer 150 and the focusing electrode 160 to allow passage of the electron beams.

In one embodiment, the focusing electrode 160 has opening portions corresponding to the respective electron emission regions 140 to separately focus the electrons emitted from the respective electron emission regions 140. In the embodiment shown in FIGS. 1 and 2, the focusing electrode 160 has only one opening portion at each pixel irrespective of the number of electron emission regions 140 to collectively focus the electrons emitted from those electron emission regions 140 at that pixel.

The height difference between the focusing electrode 160 and the electron emission region 140 increases the focusing effect. Therefore, in one embodiment, the thickness of the second insulating layer 150 is larger than the thickness of the first insulating layer 120.

The focusing electrode 160 may be formed with a conductive film coated on the second insulating layer 150, or a metallic plate having opening portions 160*a*.

Phosphor layers 210 with red, green and blue phosphor layers 210R, 210G and 210B are formed on a surface of the second substrate 20 facing the first substrate 10 such that they are spaced apart from each other. A black layer 220 is formed between the respective phosphor layers 210R, 210G and 210B to enhance the screen contrast. In this embodiment, the each of the phosphor layers 210R, 210G and 210B are arranged to correspond to the respective pixels of the first substrate 10.

An anode electrode 230 is formed on the phosphor and the black layers 210 and 220 with a metallic material such as aluminum Al. The anode electrode 230 receives a high voltage required for accelerating electron beams from the outside to cause the phosphor layers 210 to be in a high potential state. The anode electrode 230 reflects the visible rays radiated from the phosphor layers 210 to the first substrate 10 toward the second substrate 20 to increase the screen luminance.

The anode electrode may be disposed between the second substrate and the phosphor layers. In this case, the anode electrode is formed with an ITO-like transparent conductive material such that it transmits the visible rays radiated from the phosphor layers.

In another embodiment, a reflective layer based on a metallic material may be provided in addition to the anode electrode based on a transparent conductive material.

The phosphor layers 210 may be arranged at the pixels defined on the first substrate 10 in a one to one correspondence manner, or stripe-patterned in the vertical direction of the screen (in the y axis direction of the drawing). The black layer 220 may be formed with a nontransparent material such as chromium and chromium oxide.

With the above-described electron emission display, the phosphor layers 210 are formed corresponding to the electron emission elements, and one phosphor layer 210 and the one electron emission element corresponding to the phosphor layer 210 form a pixel of the electron emission display.

In addition, a plurality of spacers 300 are arranged between the first and the second substrates 10 and 20 to sustain a constant distance between the two substrates 10 and 20. The spacers 300 are arranged at the non-light emission area of the black layer 220 such that they do not intrude upon the area of the phosphor layers 210.

Referring to FIGS. 1-5, the process of driving the above-described electron emission display will now be explained in detail.

With the electron emission display, predetermined voltages are applied to the cathode electrodes 110, the gate electrodes 130, the focusing electrode 160, and the anode electrode 230, respectively.

For instance, the cathode or the gate electrodes 110 and 130 receive scanning driving voltages to function as the scanning electrodes, and the other electrodes receive data driving voltages to function as the data electrodes.

The focusing electrode 160 receives a voltage required for focusing electron beams, for instance, 0V or a negative direct current voltage of several to several tens of volts V. Then, electric fields are formed around the electron emission regions 140 at the pixels where the voltage difference between the cathode and the gate electrodes 110 and 130 exceeds the threshold value, and electrons are emitted from the electron emission regions 140 due to the electric fields.

The emitted electrons are focused by the electric field of the focusing electrode 160 while passing the opening portions 160*a* of the focusing electrode 160, and are attracted by the positive high voltage of several hundreds to several thousands of volts V applied to the anode electrode 230 to form electron beams. The electron beams then collide against the phosphor layers 210 corresponding to the respective pixels, thereby exciting the phosphor layers 210.

With the above driving process, the resistance made in-between the first and the second electrodes 112 and 114 is varied in the longitudinal direction of the cathode electrode 110. Then, the amount of the electric currents flowing to the respective electron emission regions 140 is evenly controlled due to the separate resistance value through the resistance layer 116, and accordingly, the electron emission is substantially equalized per the respective electron emission regions 140.

That is, with the electron emission display according to the above-described embodiments of the present invention, the voltage drop of the cathode electrode is reduced, and the emission of electrons from the respective electron emission regions is made substantially uniform. Consequently, the uniformity of pixel luminance is enhanced, thereby allowing display of high quality screen images.

Although examples of embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims and their equivalents.

What is claimed is:

1. An electron emission device comprising:

a substrate;

a cathode electrode comprising a first electrode portion on the substrate and having opening portions, and second electrode portions within respective ones of the opening portions such that the second electrode portions are separated from the first electrode portion;

a resistance layer electrically interconnecting the first electrode portion and the second electrode portions of the cathode electrode; and electron emission regions directly on the second electrode portions, wherein a width of the second electrode portions gradually increases along a longitudinal direction of the cathode electrode and a distance between the first electrode portion and the second electrode portions gradually decreases along the longitudinal direction of the cathode electrode.

2. The electron emission device of claim 1, wherein the resistance layer covers substantially small portions of each of the first electrode portion and the second electrode portions.

3. The electron emission device of claim 1, wherein each of the opening portions has a predetermined width in the longitudinal direction of the cathode electrode.

4. The electron emission device of claim 1, wherein the resistance layer is disposed between the first electrode portion and the second electrode portions in the longitudinal direction of the cathode electrode.

5. The electron emission device of claim 4, further comprising a second resistance layer, wherein the resistance layer and the second resistance layer are arranged at opposite sides of the second electrode portions.

6. The electron emission device of claim 1, wherein the resistance layer is disposed between the first electrode portion and the second electrode portions, and contacts a lateral side and a peripheral top surface of the first electrode portion and the second electrode portions.

7. The electron emission device of claim 1, wherein the first electrode portion is formed with a transparent conductive material.

8. The electron emission device of claim 1, wherein the second electrode portions are formed with a transparent conductive material or a metallic material.

9. The electron emission device of claim 1, wherein the resistance layer is formed with amorphous silicon.

10. The electron emission device of claim 1, wherein the electron emission regions are formed with a material selected from the group consisting of carbon nanotube, graphite, graphite nanofiber, diamond, diamond-like carbon, fullerene $C_{60}$, and silicon nanowire.

11. The electron emission device of claim 1, further comprising gate electrodes and a focusing electrode on the cathode electrode, wherein the gate electrodes are insulated from the focusing electrode.

12. The electron emission device of claim 1, wherein a single electron emission region is formed directly on each of the second electrode portions.

13. An electron emission device comprising:

a substrate;

a cathode electrode comprising a first electrode portion on the substrate and having opening portions, and second electrode portions within respective ones of the opening portions such that the second electrode portions are separated from the first electrode portion;

a resistance layer electrically interconnecting the first electrode portion and the second electrode portions of the cathode electrode; and electron emission regions directly on the second electrode portions, wherein a width of the resistance layer between the first electrode portion and the second electrode portions gradually increases in a longitudinal direction of the cathode electrode.

14. The electron emission device of claim 13, wherein the resistance layer covers substantially small portions of each of the first electrode portion and the second electrode portions.

15. An electron emission display comprising:

a substrate;

a cathode electrode comprising a first electrode portion on the substrate and having opening portions, and second electrode portions within respective ones of the opening portions such that the second electrode portions are separated from the first electrode portion;

a resistance layer electrically interconnecting the first electrode portion and the second electrode portions of the cathode electrode;

electron emission regions directly on the second electrode portions;

a counter substrate facing the substrate; and a light emission unit on a surface of the counter substrate, wherein a width of the resistance layer between the first electrode portion and the second electrode portions is gradually increases in a longitudinal direction of the cathode electrode.

16. The electron emission display of claim 15, wherein the light emission unit comprises phosphor layers on the counter substrate and an anode electrode on the counter substrate such that the anode electrode is connected to the phosphor layers.

17. The electron emission display of claim 15, wherein the resistance layer covers substantially small portions of each of the first electrode portion and the second electrode portions.

18. An electron emission display comprising:

a substrate;

a cathode electrode comprising a first electrode portion on the substrate and having opening portions, and second electrode portions within respective ones of the opening portions such that the second electrode portions are separated from the first electrode portion;

a resistance layer electrically interconnecting the first electrode portion and the second electrode portions of the cathode electrode;

electron emission regions directly on the second electrode portions;

a counter substrate facing the substrate; and a light emission unit on a surface of the counter substrate, wherein a width of the second electrode portions gradually increases along a longitudinal direction of the cathode electrode and a distance between the first electrode portion and the second electrode portions gradually decreases along the longitudinal direction of the cathode electrode.

19. The electron emission display of claim 18, wherein the light emission unit comprises phosphor layers on the counter substrate and an anode electrode on the counter substrate such that the anode electrode is connected to the phosphor layers.

20. The electron emission display of claim 18, wherein the resistance layer covers substantially small portions of each of the first electrode portion and the second electrode portions.

* * * * *

UNITED STATES PATENT AND TRADEMARK OFFICE

CERTIFICATE OF CORRECTION

PATENT NO. : 7,671,525 B2
APPLICATION NO. : 11/584128
DATED : March 2, 2010
INVENTOR(S) : Si-Myeong Kim It is certified that error appears in the above-identified patent and that said Letters Patent is hereby corrected as shown below:

In the Claims

Column 8, Claim 15, line 18 Delete "is"

Signed and Sealed this
Thirtieth Day of August, 2011

David J. Kappos

David J. Kappos
*Director of the United States Patent and Trademark Office*